US012214261B1

(12) United States Patent
Liu et al.

(10) Patent No.: US 12,214,261 B1
(45) Date of Patent: Feb. 4, 2025

(54) BUOYANT DEVICES

(71) Applicants: SHENZHEN THOUSANDSHORES TECHNOLOGY CO., LTD., Guangdong (CN); YIWU CHEN HU E-BUSINESS CO., LTD., Zhejiang (CN)

(72) Inventors: Zhi Liu, Yiwu (CN); Ding He, Shenzhen (CN)

(73) Assignees: SHENZHEN THOUSANDSHORES TECHNOLOGY CO., LTD., Shenzhen (CN); YIWU CHEN HU E-BUSINESS CO., LTD., Yiwu (CN)

( * ) Notice: Subject to any disclaimer, the term of this patent is extended or adjusted under 35 U.S.C. 154(b) by 0 days.

(21) Appl. No.: 18/536,199

(22) Filed: Dec. 11, 2023

(30) Foreign Application Priority Data

Dec. 7, 2023 (CN) ..... 202311677600.7

(51) Int. Cl.
*A63B 31/00* (2006.01)

(52) U.S. Cl.
CPC ..... *A63B 31/00* (2013.01)

(58) Field of Classification Search
CPC ..... A63B 31/00
See application file for complete search history.

(56) References Cited

U.S. PATENT DOCUMENTS 2,562,080 A * 7/1951 Barnes ..... A47C 15/006 441/131
3,604,033 A * 9/1971 Lino ..... A63B 67/007 D21/803
4,443,204 A * 4/1984 Perrin ..... A61H 37/005 434/262
4,509,744 A * 4/1985 Beasley ..... A63B 31/08 482/111
4,551,108 A * 11/1985 Bass ..... A61H 37/005 441/116
4,804,177 A * 2/1989 Rosson ..... B63B 34/50 D21/678
4,840,591 A * 6/1989 Dulin ..... A63B 23/04 441/106

(Continued)

FOREIGN PATENT DOCUMENTS

CN 203609814 U 5/2014
CN 104943834 A 9/2015

(Continued)

*Primary Examiner* — S. Joseph Morano
*Assistant Examiner* — Jovon E Hayes
(74) *Attorney, Agent, or Firm* — PORUS IP LLC

(57) ABSTRACT

The embodiments of the present disclosure provide a buoyant device including a body composed of a material with a specific gravity less than 0.3. The body is composed of a portion between a first distance and a second distance from an axis. The body includes a first portion, a second portion, and a third portion. Differences of the first portion and distance differences of the second portion are less than a distance difference of the third portion. The first portion includes a first difference group and a second difference group composed of a plurality of distance differences, and distance differences of the first difference group are greater than distance differences of the second difference group. The second portion is located away from the axis relative to the first portion.

20 Claims, 13 Drawing Sheets

(56) References Cited

U.S. PATENT DOCUMENTS

| | | | | | |
|---|---|---|---|---|---|
| 5,092,589 | A * | 3/1992 | Packer | A63B 23/03575 | 482/92 |
| 6,199,676 | B1 * | 3/2001 | Targiroff | B64D 25/14 | 193/25 B |
| 6,692,322 | B1 * | 2/2004 | Heatherly | B63B 34/50 | 441/120 |
| 6,884,136 | B1 * | 4/2005 | McCarthy | A63B 31/00 | 441/64 |
| 7,267,509 | B1 * | 9/2007 | Jackson, III | B63C 9/155 | 441/88 |
| 8,651,909 | B2 * | 2/2014 | Romzek | B63B 3/08 | 114/230.2 |
| 11,753,124 | B2 * | 9/2023 | Srikanta Prasad | B63C 9/04 | 114/345 |
| 2008/0254694 | A1 * | 10/2008 | Spinoza | B63C 9/155 | 441/108 |
| 2009/0075537 | A1 | 3/2009 | Devers | | |
| 2013/0280972 | A1 * | 10/2013 | Cheung | A63H 23/10 | 441/129 |
| 2013/0323990 | A1 * | 12/2013 | Justice | A63B 21/0084 | 441/88 |

FOREIGN PATENT DOCUMENTS

| | | | | | |
|---|---|---|---|---|---|
| CN | 213912226 | U | | 8/2021 | |
| EP | 3467235 | B1 | * | 12/2020 | E04H 4/1263 |
| GB | 2430411 | A | * | 3/2007 | B63C 9/15 |
| WO | 2021071729 | A1 | | 4/2021 | |

* cited by examiner

BUOYANT DEVICES

CROSS-REFERENCE TO RELATED APPLICATION

The application claims priority of Chinese Patent Application No. 202311677600.7, filed on Dec. 7, 2023, the entire contents of which are incorporated herein by reference.

TECHNICAL FIELD

The present disclosure relates to the field of water fitness devices, and in particular, to buoyant devices.

BACKGROUND

Water-based aerobic exercise has numerous benefits, such as reducing blood pressure, increasing bone density, strengthening muscles, correcting posture, alleviating pain, and aiding weight loss. For individuals who are injured, obese, or elderly, water-based aerobic exercise is a low-impact form of exercise, making it more user-friendly. However, current fitness equipment for water-based aerobic exercise is lacking in versatility and can only be used in limited scenarios.

Therefore, it is desirable to provide a buoyant device specifically designed for water-based aerobic exercises that can cater to various needs and usage requirements.

SUMMARY

According to one or more embodiments of the present disclosure, a buoyant device is provided. The buoyant device includes: a body composed of a material with a specific gravity less than 0.3; the body is composed of a portion between a first distance and a second distance from an axis of the body, the first distance is between 2.5 cm and 5.5 cm, the distance difference between the second distance and the first distance is between 2.5 cm and 4.5 cm; the body includes a first portion, a second portion, and a third portion, according to a deformation of the body, an overlapping portion between the first portion and the second portion based on a rotation angle of the axis changes; and one or more distance differences of the first portion and one or more distance differences of the second portion are less than the distance difference of the third portion; the first portion includes a first difference group and a second difference group composed of a plurality of distance differences, a rotation angle corresponding to the first difference group is greater than a rotation angle corresponding to the second difference group, and one or more distance differences of the first difference group are greater than one or more distance differences of the second difference group; the second portion includes a third difference group and a fourth difference group composed of a plurality of distance differences, a rotation angle corresponding to the third difference group is greater than a rotation angle corresponding to the fourth difference group, and one or more distance differences of the third difference group are less than one or more distance differences of the fourth difference group; and the second portion is located away from the axis relative to the first portion.

In some embodiments, the buoyant device further includes a deformation determining member, and the deformation determining member is configured to fix the deformation of the body.

In some embodiments, the body includes a plurality of detachable components, and the plurality of detachable components are connected to each other by at least one connecting member.

In some embodiments, the detachable components include at least two buoyancy group components, the buoyancy group components are connectable to each other and configured to be connectable to the body above; and the detachable components further include a container component configured to be placed on top of the at least two buoyancy group components to form an accommodating space.

In some embodiments, the third portion includes a first sub-piece and a second sub-piece that are interchangeable, the first sub-piece causes the first distance of the body to be between 5.5 cm and 6.5 cm, and the second sub-piece causes the first distance of the body to be between 6 cm and 7 cm.

In some embodiments, the body includes a multi-layer structure, and material densities of at least two layers are different.

In some embodiments, one layer of the multi-layer structure is an airbag layer.

In some embodiments, at least one connecting member is further disposed on at least one cross-section of the body, the at least one cross-section of the body satisfies: an outer distance difference being less than an inner distance difference; and the at least one cross-section is an intersection of a plane where the axis is located with the body.

In some embodiments, the deformation determining member includes a wrapping mesh, and the wrapping mesh is composed of a dense waterproof fabric.

In some embodiments, the deformation determining member includes one or more of a hook and loop tape, an elastic band, a hook, a buckle, and a reel.

In some embodiments, the outer side of the body includes a water-resistant structure.

In some embodiments, the water-resistant structure is disposed on a circular assembly, and the circular assembly is capable of being embedded in the body at different angles.

In some embodiments, the water-resistant structure is a collapsible water-resistant structure.

In some embodiments, an outermost material of the buoyant device is a material with a low friction coefficient, or an outer side of the body is a coating material with a low friction coefficient.

In some embodiments, the buoyant device further includes a strap, and the strap connects the deformation determining member and the body.

In some embodiments, at least one end face of the body satisfies: a plurality of distance differences arranged along a direction perpendicular to an axis plane include at least two local maximum points.

BRIEF DESCRIPTION OF THE DRAWINGS

The present disclosure will be further illustrated by way of exemplary embodiments, which will be described in detail by means of the accompanying drawings. These embodiments are not limiting, and in these embodiments, the same numbering indicates the same structure, wherein.

DETAILED DESCRIPTION

Figure 1:
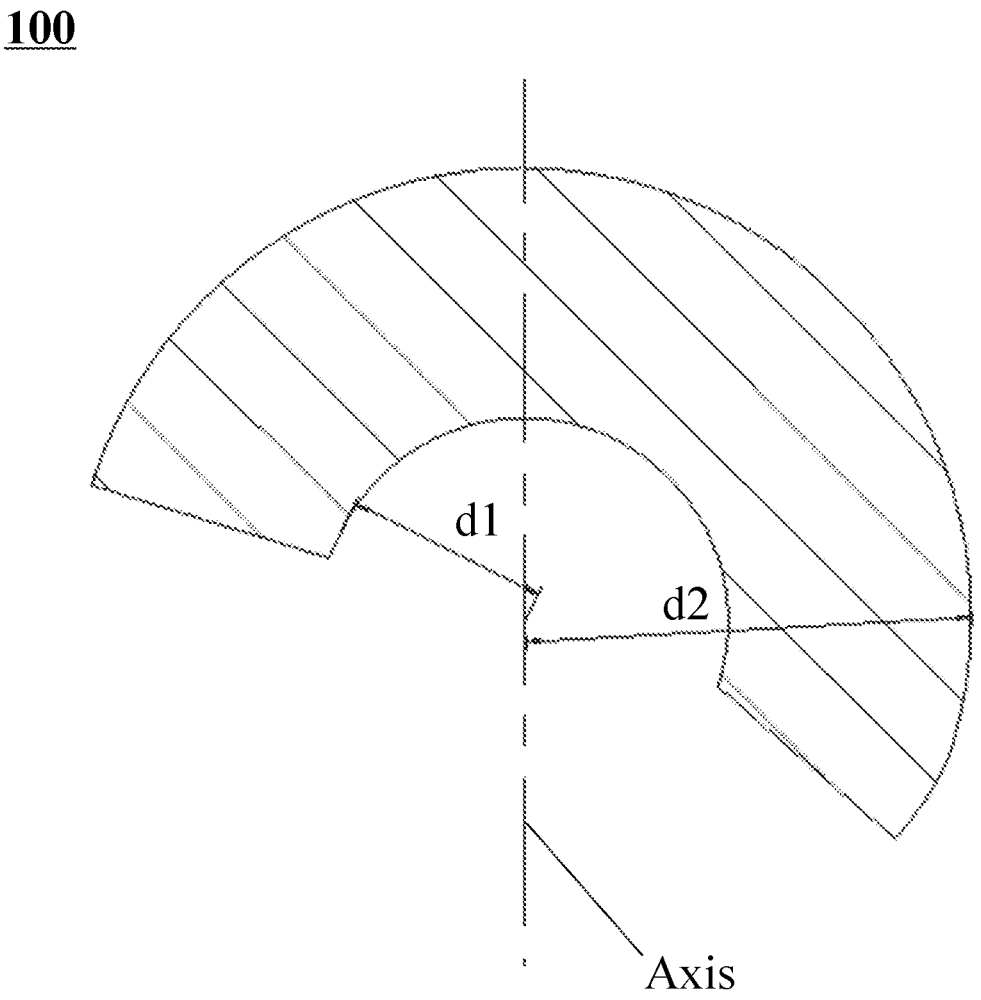
FIG. 1 is a schematic diagram illustrating an exemplary body according to some embodiments of the present disclosure.

In order to illustrate the technical solutions related to the embodiments of the present disclosure, a brief introduction of the drawings referred to in the description of the embodiments is disposed below. Obviously, the drawings described below are only some examples or embodiments of the present disclosure. Those skilled in the art, without further creative efforts, may apply the present disclosure to other similar scenarios according to these drawings. Unless apparent from the locale or otherwise stated, like reference numerals represent similar structures or operations throughout the several views of the drawings.

It will be understood that the term "system," "device," "unit," and/or "module" used herein are one method to distinguish different components, elements, parts, sections, or assemblies of different levels in ascending order. However, the terms may be displaced by another expression if they achieve the same purpose.

As used in the disclosure and the appended claims, the singular forms "a," "an," "a kind of," and/or "the" may include plural forms unless the content clearly indicates otherwise. In general, the terms "comprise," "comprises," and/or "comprising," "include," "includes," and/or "including," merely prompt to include steps and elements that have been clearly identified, and these steps and elements do not constitute an exclusive listing. The methods or devices may also include other steps or elements.

The flowcharts used in the present disclosure illustrate operations that systems implement according to some embodiments in the present disclosure. It is to be expressly understood, the operations of the flowchart may be implemented not in order. Conversely, the operations may be implemented in an inverted order, or simultaneously. Moreover, one or more other operations may be added to the flowcharts. One or more operations may be removed from the flowcharts.

Water-based aerobic exercise includes water walking, swimming, water aerobics, and water cycling. When an exerciser exercises underwater, the buoyancy of water reduces pressure on joints, and at the same time, the resistance of the water increases the intensity of the exercise, so that the water-based aerobic exercise is a good way of exercising, and it is also widely used in scenarios, e.g. aquatic physical therapy, muscle toning, and water training. Some embodiments of the present disclosure provide a buoyant device that may be sleeved onto a position such as an arm, a wrist, and an ankle to provide the buoyancy and the resistance for the exerciser, thereby improving the safety of the exercise. The buoyant device does not need to take up both hands and has a plurality of functions.

FIG. 1 is a schematic diagram illustrating an exemplary body according to some embodiments of the present disclosure. Some of the following embodiments may be understood with reference to FIG. 1, but the accompanying drawings are merely illustrations of part of implementations, and are not intended to limit the scope of the implementations.

In some embodiments, as shown in FIG. 1, the buoyant device includes a body 100, and the body 100 includes a material with a specific gravity less than 0.3. The body 100 refers to a main portion of the buoyant device that generates buoyancy in water. The specific gravity less than 0.3 refers to a material density less than 0.3 $kg/cm^3$.

For example, the material of the body may be polyethylene (PE), polyurethane (PU), foam rubber, etc.

In some embodiments, the body 100 is composed of a portion between a first distance d1 and a second distance d2 from an axis of the body 100. In some embodiments, the first distance d1 is between 2.5 cm and 5.5 cm, and a distance difference between the second distance d2 and the first distance d1 is between 2.5 cm and 4.5 cm. In some embodiments, the first distance d1 is between 5 cm and 6 cm, and the distance difference between the second distance d2 and the first distance d1 is between 2.5 cm and 5 cm. In some embodiments, the first distance d1 is between 6 cm and 8 cm, and the distance difference between the second distance d2 and the first distance d1 is between 3 cm and 6 cm. In some embodiments, the first distance d1 is between 3 cm and 5 cm, and the distance difference between the second distance d2 and the first distance d1 is between 1.5 cm and 4.5 cm. In some embodiments, the first distance d1 is between 4 cm and 6.5 cm, and the distance difference between the second distance d2, and the first distance d1 is between 2 cm and 5 cm. In some embodiments, the first distance d1 is between 7 cm and 9 cm, and the distance difference between the second distance d2 and the first distance d1 is between 5 cm and 8 cm.

The axis of the body 100 is a virtual straight line used to describe a feature of the body. FIG. 1 provides a diagrammatic illustration of related concepts. In FIG. 1 and other accompanying drawings, shapes of the body are merely used to illustrate the related concepts or schematic illustrations. Unless specifically stated, the shapes of the body of the embodiments are not limited by the accompanying drawings.

Figure 2:
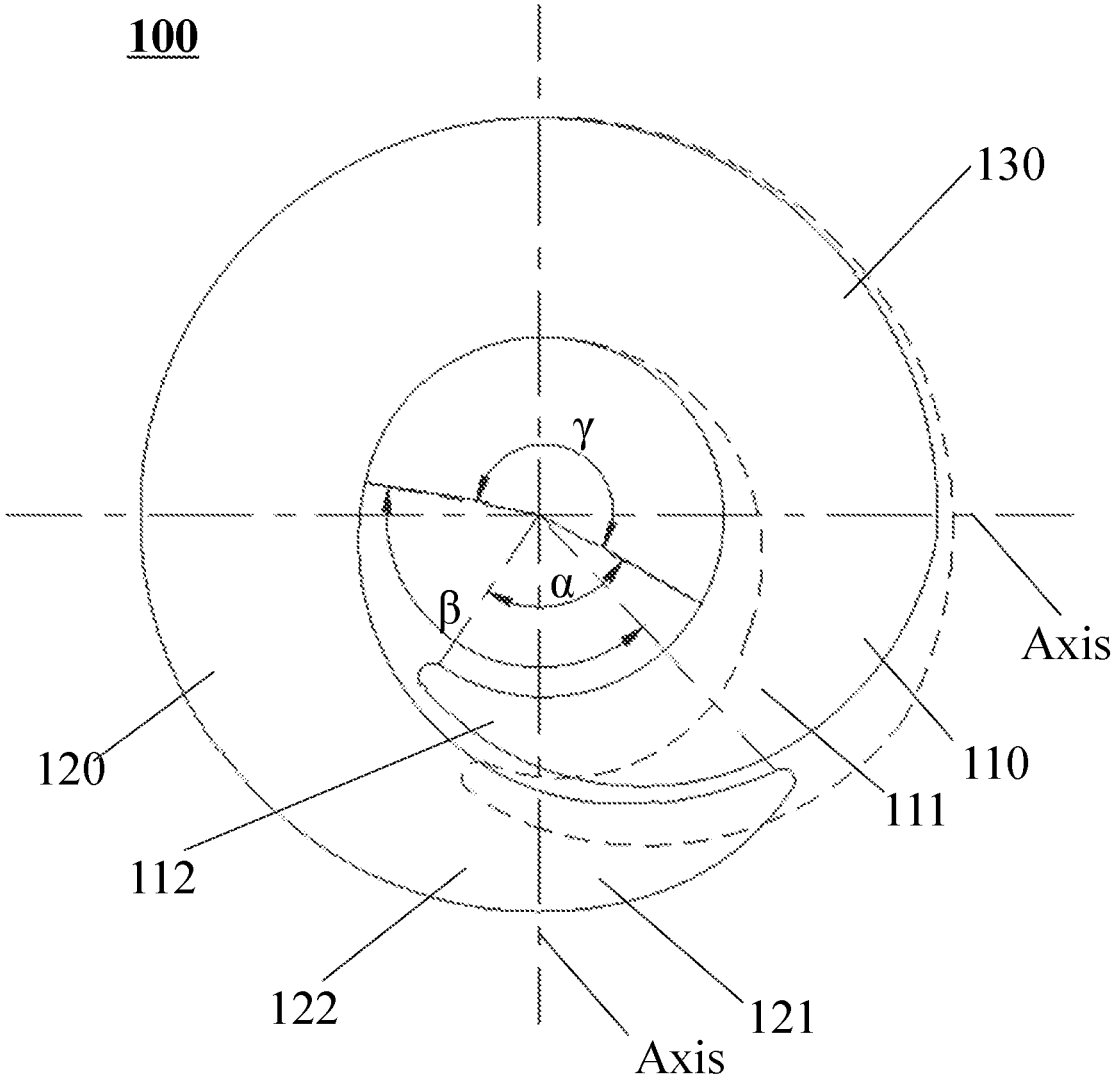
FIG. 2 is a conceptual diagram illustrating an exemplary rotation angle according to some embodiments of the present disclosure.

FIG. 2 is a conceptual diagram illustrating an exemplary rotation angle according to some embodiments of the present disclosure.

According to the axis of the body 100, a position of a 0-degree angle for describing may be arbitrarily specified. Accordingly, a rotation angle relative to the 0-degree angle for any point in the body may be determined. For a region, the rotation angle is a range of rotation angles for its constituent points. FIG. 2 provides a diagrammatic illustration of the related concepts.

In some embodiments, the body 100 includes a first portion 110, a second portion 120, and a third portion 130, and an overlapping portion between the first portion 110 and the second portion 120 based on the rotation angle of the axis changes according to a deformation of the body 100. For example, a rotation angle $\alpha$ of the first portion 110 is within a range of 30 to 90 degrees, a rotation angle $\gamma$ of the third portion 130 is within a range of 90 to 260 degrees, and a rotation angle $\beta$ of the second portion 120 is within a range of 260 to 450 degrees. When the body is deformed (as shown in FIG. 1, the dotted line is schematic after the first portion 110 is deformed), the rotation angle $\alpha$ of the first portion 110 is within a range of 40 to 120 degrees, the rotation angle $\gamma$ of the third portion 130 is within a range of 120 to 250 degrees, and the rotation angle $\beta$ of the second portion 120 is within a range of 250 to 420 degrees.

The related concepts are merely used to illustrate the feature of an object, which may be determined based on any other substantively equivalent means manner, and is not limited by the manner of description.

In some embodiments, one or more distance differences of the first portion 110 and one or more distance differences of the second portion 120 are less than a distance difference of the third portion 130. More descriptions regarding the deformation of the body 100 may be found in FIG. 2.

In some embodiments, the first distance d1 indicates an approximation value of an inner radius of the body 100, and the distance difference between the second distance d2 and the first distance d1 may indicate an approximate thickness of the body 100.

In some embodiments, as shown in FIG. 2, the first portion 110 includes a first difference group 111 and a second difference group 112 composed of a plurality of distance differences, the rotation angle corresponding to the first difference group 111 is greater than the rotation angle corresponding to the second difference group 112, and one or more distance differences of the first difference group 111 are greater than one or more distance differences of the second difference group 112. The second portion 120 includes a third difference group 121 and a fourth difference group 122 composed of a plurality of distance differences, the rotation angle corresponding to the third difference group 121 is greater than the rotation angle corresponding to the fourth difference group 122, and one or more distance differences of the third difference group 121 are less than one or more distance differences of the fourth difference group 122.

The above rules for variation of the rotation angle and the distance difference may indicate that the approximate thickness of the body 100 changes according to a rule so that the first portion 110 and the second portion 120 have an overlapping portion.

In some embodiments, the second portion 120 is located away from the axis of the body 100 relative to the first portion 110.

In some embodiments of the present disclosure, by setting the rules for variation of the rotation angle and the distance difference, a deformation size of the body may develop in a direction anticipated by a user when the body is deformed by an external force, and suitable rules for variation may reduce the external force required for the deformation, thereby increasing a comfort degree of a use of the buoyant device.

Figure 3:
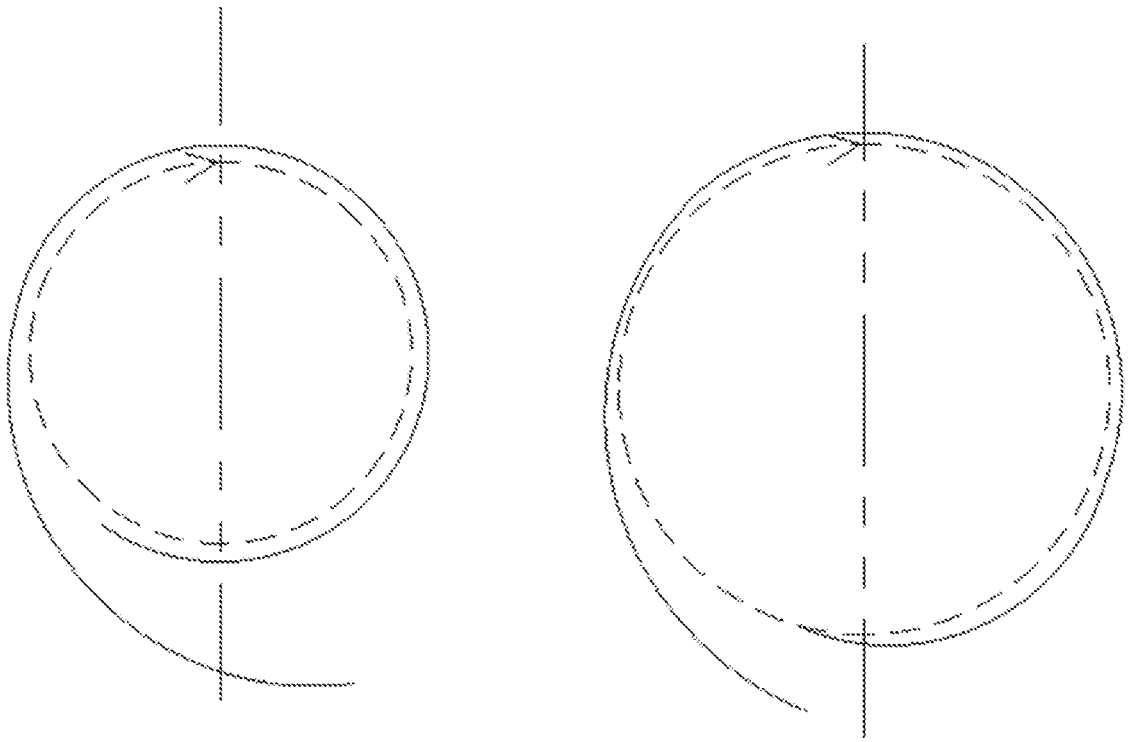
FIG. 3 is a schematic diagram illustrating an exemplary deformation of a body according to some embodiments of the present disclosure.

FIG. 3 is a schematic diagram illustrating an exemplary deformation of a body according to some embodiments of the present disclosure.

In some embodiments, the deformation of the body 100 means that the body 100 deforms after it is subjected to an external force, and an overlapping size of the overlapping portion of the first portion 110 and the second portion 120 changes, such that the size of the body 100 changes. As shown in FIG. 3, the size of the body 100 may change from a state 1 to a state 2. Dashed arrows in the figure indicate an inner circumference of the body 100, and as shown in FIG. 3, when the body 100 changes from state 1 to state 2, the inner circumference of the body 100 increases. In some embodiments, when the first distance d1 is between 2.5 cm and 5.5 cm, the inner circumference of the body 100 may change within a range of 15 cm to 35 cm.

In some embodiments, the buoyant device further includes a deformation determining member, and the deformation determining member is configured to fix the deformation of the body.

The deformation determining member may be in a variety of forms. In some embodiments, the deformation determining member may be the body 100 itself, utilizing a resilience of the material of the body for fixation. For example, when no external force is applied, the body 100 is in a state with the smallest inner circumference, and when the exerciser extends a wrist into the body 100 to stretch the body 100 open, the resilient of the material fix the body to the wrist of the exerciser. In other embodiments, the deformation determining member includes one or more of a hook and loop tape, an elastic band, a hook, a buckle, and a reel, which is found in the description below.

In some embodiments, the deformation determining member is the book and loop tape, and the hook and loop tape is disposed on an outer side of the body or on an inner side of the body. In some embodiments, the hook and loop tape is disposed on the outer side of the body. The hook and loop tape includes two sides, one side of fine, soft fibers and another side of stiffer barbed hairs with hooks. The hook and loop tape may detachably adjust the deformation of the body 100. In some embodiments, the hook and loop tape is fixed to the second portion 120 after extending from the first portion 110 to the second portion 120. In some other embodiments, the deformation determining member may be the hook and loop tape of the first portion 110 fixed to the first portion 110 by folding back through a loop buckle (e.g., a U-bent wire) fixed to the second portion 120. The above folding back fixation may merely dispose of a relatively short hook and loop tape on the first portion 110, favorably reducing a length of the hook and loop tape.

In some embodiments, the deformation determining member is the elastic band that is disposed on the outer side of the body or the inner side of the body, and tensioning of the elastic band may fix the body to the wrist or the ankle of the exerciser when the body 100 is stretched open.

In some embodiments, the deformation determining member is the hook mating with a fastener, and the hook is disposed on the inner side of the first portion 110. The fastener mates with the hook and is disposed on the outer side of the second portion 120. Alternately, the deformation determining member is disposed at other locations where the hook and the fastener may be connected. In some embodiments, deformations of the body 100 in different sizes may be fixed by a hook fixing a plurality of fasteners or a plurality of hook fixing a fastener. The fastener may be in the form of a groove on the body 100 or a component fixed to the body with a groove or one or more holes. The hook may be in the form of a hook-shaped structure that protrudes outwardly. When the exerciser wears the buoyant device, the hook-shaped structure of the hook is inserted into the groove or the hole of the fastener, and the hook and the fastener lock with each other to complete the fixation.

In some embodiments, the deformation determining member is the buckle, and the buckle includes a male buckle and a female buckle. The buckle refers to a structure that utilizes the deformation of a ductile material to connect the male buckle and the female buckle. The buckle is disposed in a similar location as the hook and loop, and will not be described further. In some embodiments, the deformation determining member is the reel. The reel includes a fixing rope, a crimping disk, a fixing clip, etc. The fixing rope is wrapped around the crimping disk, and the length of the fixing rope is adjusted by rotating the crimping disk and is fixed with the fixing clip after adjustment. The fixing rope of the reel is sleeved on an outer circumference of the body 100, and the size of the deformation of the body is adjusted by adjusting the length of the fixing rope.

In some embodiments, the deformation determining member includes a wrapping mesh, and the wrapping mesh wraps around the outer circumference of the body. In some embodiments, the wrapping mesh is composed of a dense waterproof fabric, such as polyester or nylon material. The wrapping mesh has a certain elasticity and utilizes its elasticity to fix the deformation of the body. The wrapping mesh may completely enclose an inner layer of the body providing the buoyancy, reducing an exposed portion, effectively preventing water and dirt from penetrating an interior of the buoyant device, reducing oxidation, and becoming more durable. At the same time, it is also easy to clean the buoyancy device, so that the user may keep an outer layer clean and dry by simply washing and wiping.

In some embodiments, the body 100 includes a plurality of detachable components, the plurality of detachable components are connected to each other by one or more connecting members. In some embodiments, the connecting member may be the above hook and loop tape, and the hook and loop tape is disposed at connection locations of the plurality of detachable components. More descriptions regarding the hook and loop tape may be found in the above disclosure.

In some embodiments, the connecting member is disposed on a cross-section of the body, the at least one cross-section of the body satisfies that an outer distance difference is less than an inner distance difference, and the at least one cross-section is an intersection of a plane where the axis is located with the body.

Figure 4A:
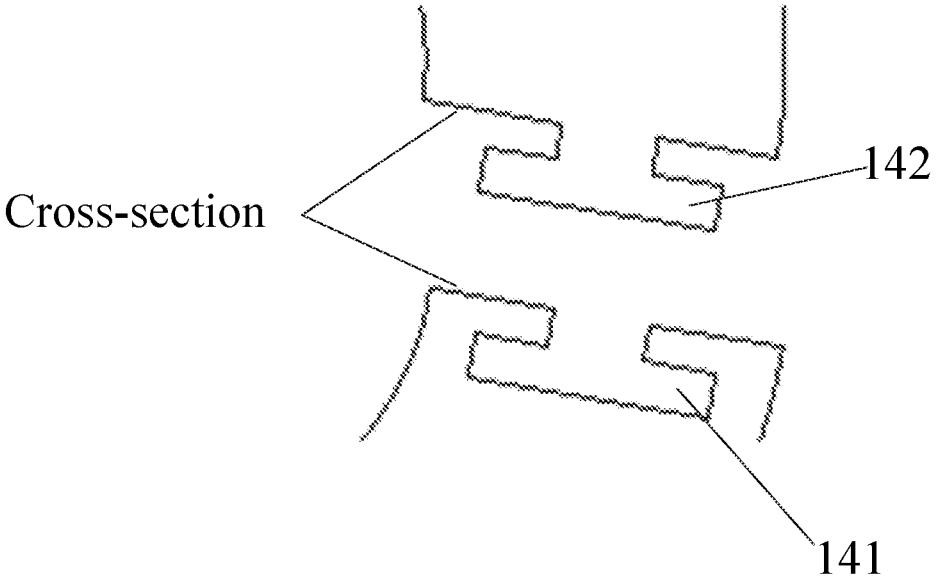
FIG. 4*a* is a structural diagram illustrating an exemplary section view of a connecting member according to some embodiments of the present disclosure.
Figure 4B:
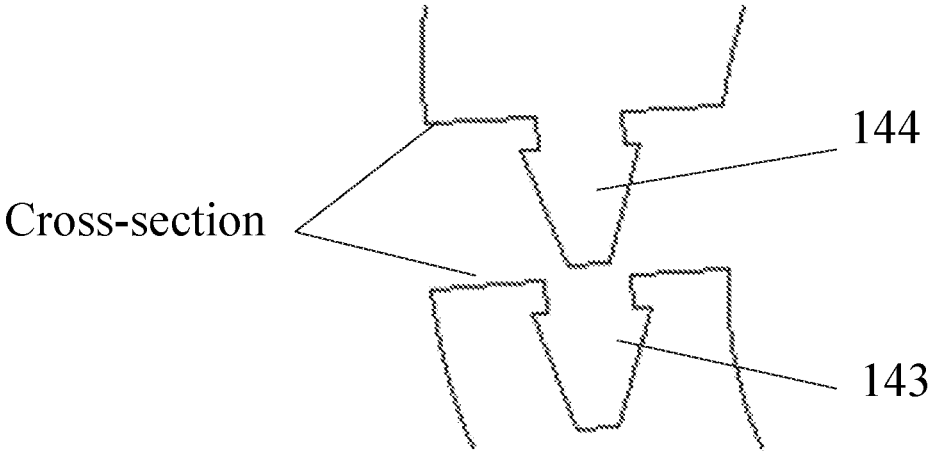
FIG. 4*b* is a structural diagram illustrating an exemplary section view of another connecting member according to some embodiments of the present disclosure.

FIG. 4*a* is a structural diagram illustrating an exemplary section view of a connecting member according to some embodiments of the present disclosure. FIG. 4*b* is a structural diagram illustrating an exemplary section view of another connecting member according to some embodiments of the present disclosure.

In some embodiments, as shown in FIG. 4*a*, the connecting member includes a groove 141 and a protrusion 142 disposed on cross-sections of different components, the outer side of the groove 141 has a step feature, which is capable of hindering the protrusion 142 from being dislodged from the groove 141 when connected. In some embodiments, the protrusion 142 is an elastic material, and a deformation compression of the protrusion 142 is utilized to tuck the protrusion 142 into the groove 141. In some embodiments, cavities of the groove 141 include a rectangular body cavity and a cylindrical body cavity in order from the outer side to the inner side, and a width of the rectangular body cavity is much smaller than a diameter of the cylindrical body cavity. The protrusion 142 is in a rectangular shape. The protrusion 142 is rotated by 90 degrees after tucking into the cylindrical body cavity of the groove 141, a width direction of the rectangular body cavity catches the protrusion 142.

In some embodiments, as shown in FIG. 4*b*, the connecting member includes a conical groove 143, a conical protrusion 144, and the conical protrusion 144 is larger than the conical groove 143. When the conical protrusion 144 is tucked into the conical groove 143, the conical protrusion 144 may be filled with an overall cavity, while a conical surface in contact may be well sealed due to extrusion, such that the water can not flow into the connecting member, and the buoyancy of the body of the buoyant device may not be affected.

In some embodiments, a plurality of detachable components are arranged in different sizes and shapes, and the buoyant device with multiple functions may be obtained by combining the plurality of detachable components of different sizes and shapes.

In some embodiments, the third portion includes a first sub-piece and a second sub-piece that are interchangeable, the first sub-piece causes the first distance of the body to be between 5.5 cm and 6.5 cm, and the second sub-piece causes the first distance of the body to be between 6 cm and 7 cm. In some embodiments, the first sub-piece causes the first distance of the body to be between 2.5 cm to 5 cm, and the second sub-piece causes the first distance of the body to be between 4.5 cm to 7 cm. In some embodiments, the first sub-piece causes the first distance of the body to be between 2 cm to 4 cm, and the second sub-piece causes the first distance of the body to be between 4 cm to 6 cm. In some embodiments, the first sub-piece causes the first distance of the body to be between 6.5 cm to 8 cm and the second sub-piece causes the first distance of the body to be between 8 cm to 13 cm. Different third portions of the sub-piece allow the buoyant device to be applied to more body portions, for example, when the first distance of the body is between 5.5 cm to 6.5 cm, the buoyant device may be applied to an arm of an adult male, and when the first distance of the body is between 6 cm to 7 cm, the buoyant device may be applied to the arm of an adult male. The first distances of the first sub-piece and the second sub-piece corresponding to the body are not limited herein, for example, when the size of the first sub-piece is larger, the first distance of the body is increased, so that the buoyant device may also be applied to the neck, the waist, etc., of the body.

In some embodiments of the present disclosure, interchangeable sub-pieces may cause the buoyant device to be formed in a variety of sizes that may be worn on a plurality of body portions, improving an applicability of the buoyant device.

Figure 5A:
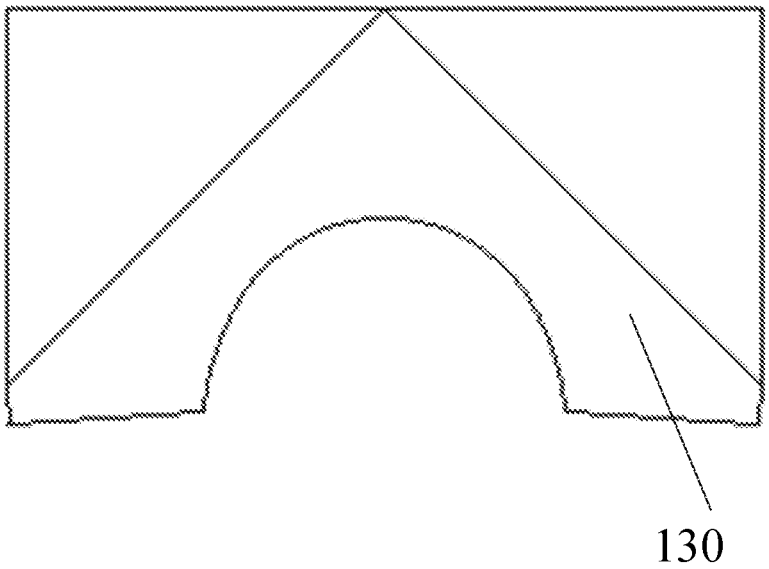
FIG. 5*a* is a schematic diagram illustrating an exemplary combination of detachable components according to some embodiments of the present disclosure.
Figure 5B:
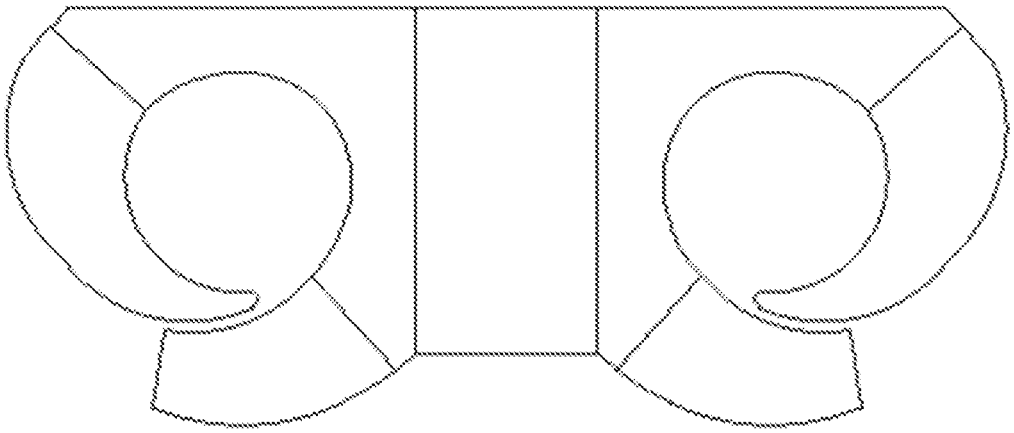
FIG. 5*b* is a schematic diagram illustrating another exemplary combination of detachable components according to some embodiments of the present disclosure.

FIG. 5*a* is a schematic diagram illustrating an exemplary combination of detachable components according to some embodiments of the present disclosure. FIG. 5*b* is a schematic diagram illustrating another exemplary combination of detachable components according to some embodiments of the present disclosure.

In some embodiments, as shown in FIG. 5*a*, to facilitate being connected to other detachable components, a side of the third portion may be a plane, and the plane may be easy to fabricate and easy to connect. The exerciser may combine the detachable components flexibly so that the shape of the buoyant device meets the needs. By connecting the detachable components of different shapes, an overall shape of the buoyant device may also be circular, fan-shaped, irregularly shaped, etc., and is not limited herein.

In some embodiments, as shown in FIG. 5*b*, the buoyant device formed by the plurality of detachable components may be worn on the feet of the exerciser. When worn on the feet of the exerciser, the buoyant device may be used for training in specific movements of swimming. For example, the buoyant device may be used as an effective swimming teaching aid. Specifically, the buoyant force of the buoyant device causes the exerciser to float on water, which enables the waist of the exerciser to move in left and right directions similar to fish swimming, and assists the exerciser in using a correct swimming posture as well as in strengthening muscle strength of upper limbs and psoas muscles.

In some embodiments, the detachable components include at least two buoyancy group components, the buoyancy group components are connectable to each other and configured to be connectable to the body. The detachable components further include a container component configured to be placed on top of the at least two buoyancy group components to form an accommodating space.

Figure 6:
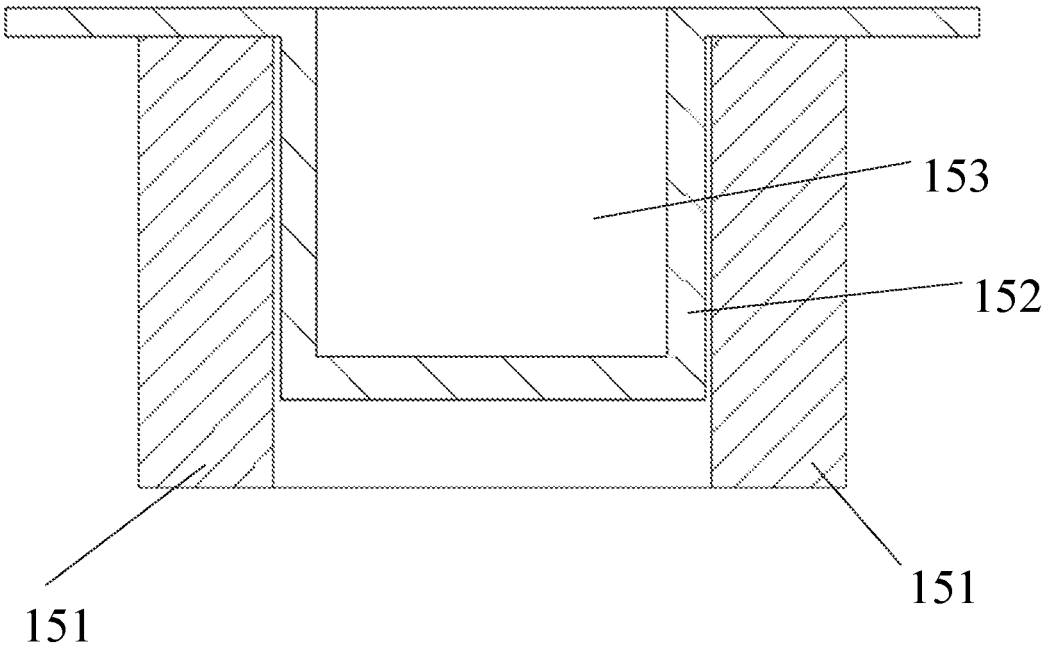
FIG. 6 is a structural diagram illustrating an exemplary section view of a container component according to some embodiments of the present disclosure.

FIG. 6 is a structural diagram illustrating an exemplary section view of a container component according to some embodiments of the present disclosure.

In some embodiments, as shown in FIG. 6, the detachable components include at least two buoyancy group components 151 and a container component 152, the two buoyancy group components 151 are connected as the body, and the container component 152 is placed on top of the two buoyancy group components 151 to form an accommodating space 153. Exemplary, the two buoyancy group components 151 may be the third portion of the above FIG. 4*b*, the body connected by the two buoyancy group components 151 has a cylindrical space, and the container component 152 may be cylindrical. A plurality of buoyancy group components 151 may also be connected as a body with other shapes (e.g., rectangular), and the container component 152 may be placed correspondingly on top of the plurality of buoyancy group components 151.

The accommodating space may accommodate drinks, snacks, fruits, cell phones, and other items, at this time the buoyant device may act as a floating tray in water or a floating food holder in water, which is suitable for a variety of scenarios such as swimming pools, bathtubs, and beaches.

In some embodiments, the outer side of the body includes a water-resistant structure. The water-resistant structure refers to a component that creates resistance to water flow, thereby increasing the resistance of the body. When the buoyant device is worn, the water-resistant structure may increase the resistance to movement in the water and increase the effectiveness of the exercise.

Figure 7:
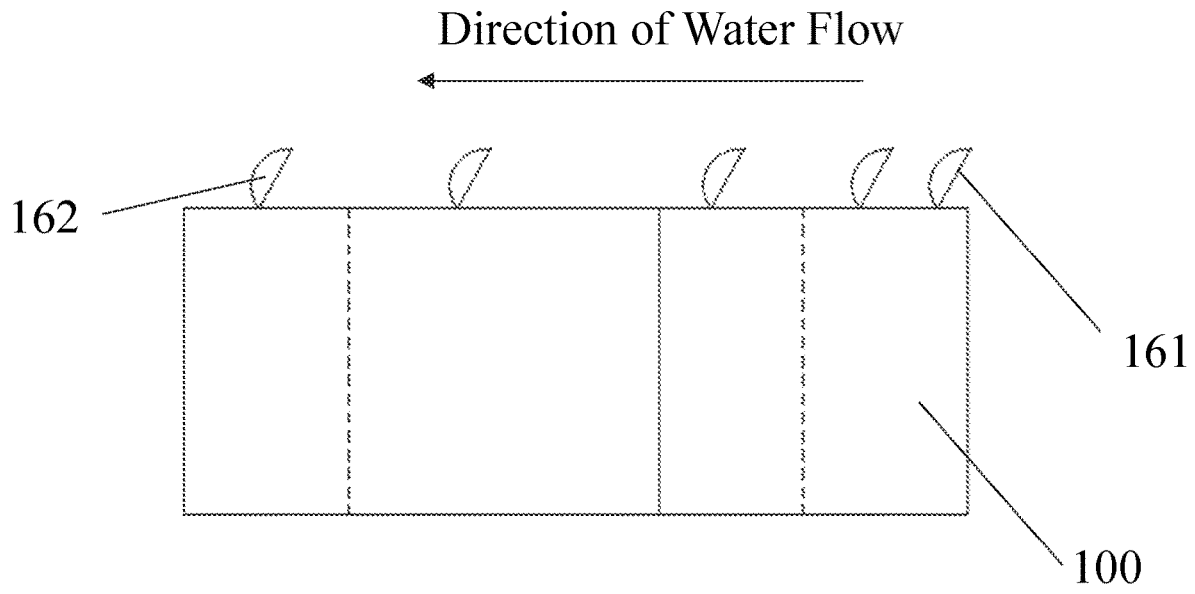
FIG. 7 is a structural diagram illustrating an exemplary section view of a water-resistance structure according to some embodiments of the present disclosure.

FIG. 7 is a structural diagram illustrating an exemplary section view of a water-resistance structure according to some embodiments of the present disclosure.

In some embodiments, as shown in FIG. 7, the water-resistant structure may include an embedded assembly, the embedded assembly may be embedded in the body 100 at different angles, and the embedded assembly partially protrudes relative to the body 100 to provide a water-resistant effect. In some embodiments, as shown in FIG. 7, an arrow is a direction of water flow, the water-resistant structure may include a waterproof mesh pocket 162 with an opening, the waterproof mesh pocket 162 may be connected to the embedded assembly 161, and the embedded assembly 161 may be embedded in the body 100 at different angles according to the needs of the exerciser. When the embedded assembly 161 is perpendicular to the direction of water flow, the water-resistant mesh pocket 162 is filled with water, and an area of the water-resistant mesh pocket 162 relative to the the direction of the water flow is the largest, at which time the resistance the buoyant device is subject to is the greatest. In some embodiments, the embedded assembly 162 may be connected to the body through a hook and loop tape, which is similar to the above and may be found in the foregoing description.

Figure 8A:
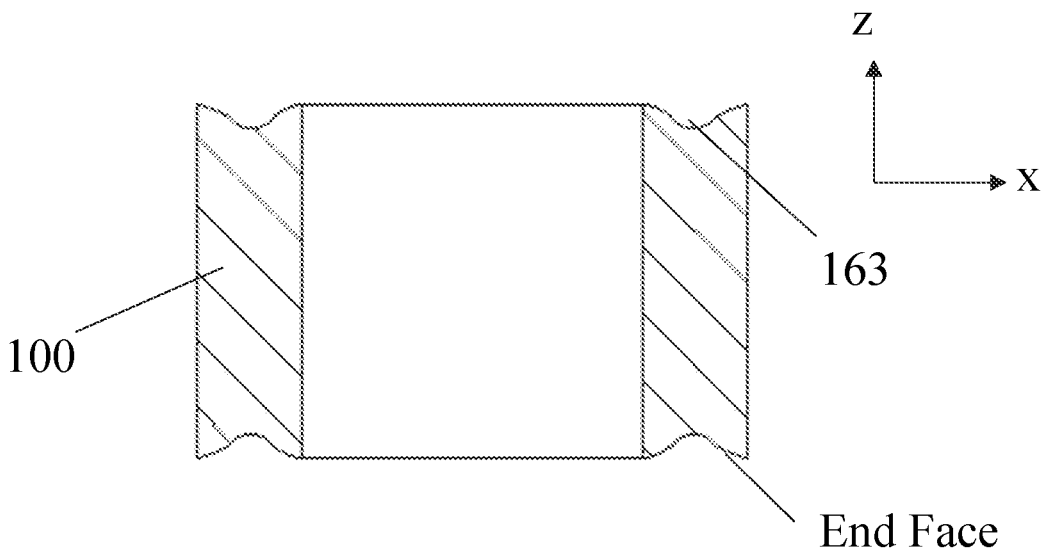
FIG. 8*a* is a three-dimensional structural diagram illustrating another exemplary water-resistant structure according to some embodiments of the present disclosure.
Figure 8B:
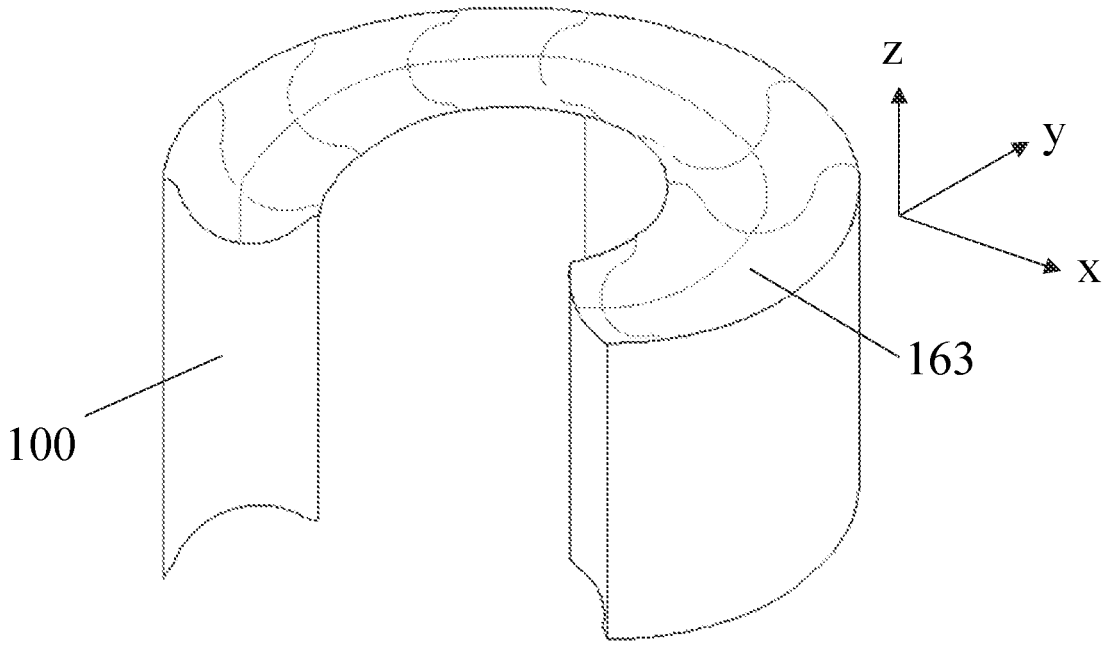
FIG. 8*b* is a side section view illustrating another exemplary water-resistance structure according to some embodiments of the present disclosure.

FIG. 8*a* is a three-dimensional structural diagram illustrating another exemplary water-resistant structure according to some embodiments of the present disclosure. FIG. 8*b* is a side section view illustrating another exemplary water-resistance structure according to some embodiments of the present disclosure.

In some embodiments, as shown in FIG. 8*a* and FIG. 8*b*, an end face of the body satisfies that a plurality of distance differences arranged along a direction perpendicular to an axis plane include at least two local maximum points. The water-resistant structure 160 refers to a curved surface feature 163 formed by a plurality of localized maximum points on the end face of the body. The curved surface feature 163 may be a concave surface, a wavy surface, or a jagged concave-convex surface that increases a contact area with water through the curved surface, thereby increasing the resistance.

Figure 9A:
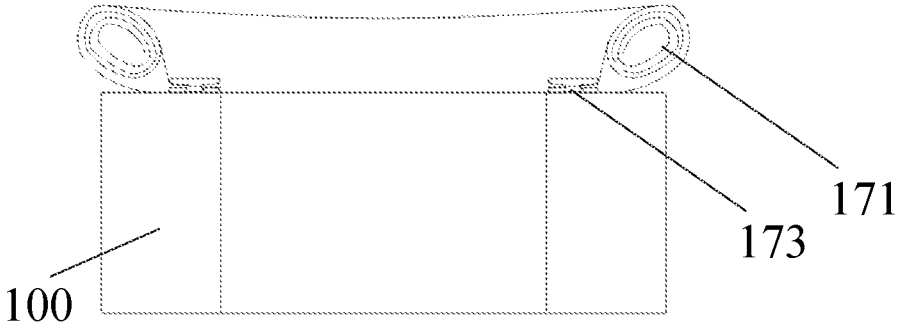
FIG. 9*a* is a folded schematic diagram illustrating an exemplary collapsible water-resistant structure according to some embodiments of the present disclosure.
Figure 9B:
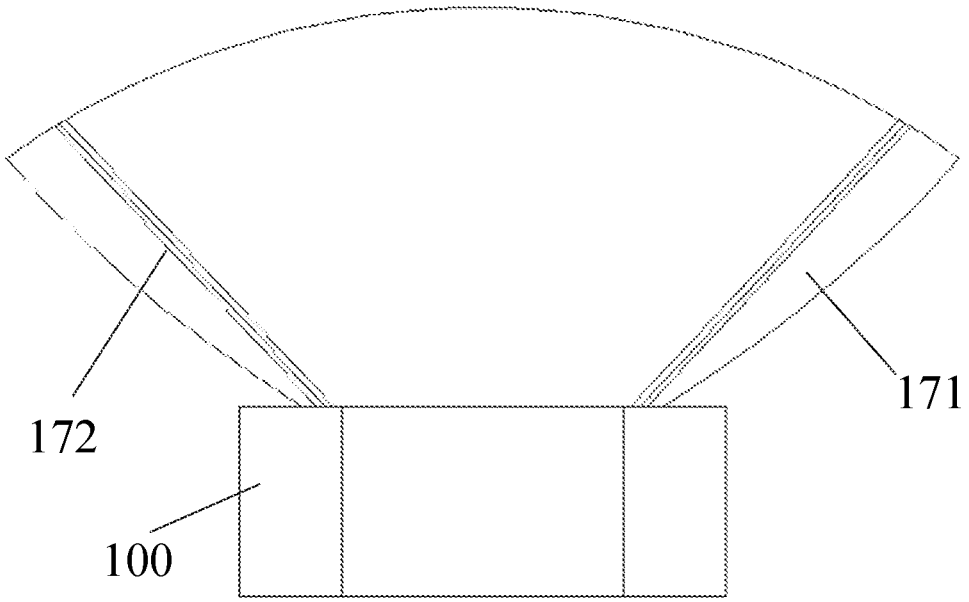
FIG. 9*b* is an unfolded schematic diagram illustrating an exemplary collapsible water-resistant structure according to some embodiments of the present disclosure.
Figure 9C:
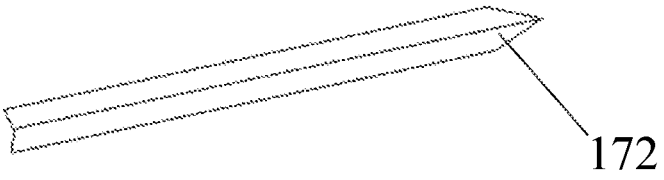
FIG. 9*c* is a schematic diagram illustrating an exemplary telescoping strip of a collapsible water-resistant structure according to some embodiments of the present disclosure.

FIG. 9*a* is a folded schematic diagram illustrating an exemplary collapsible water-resistant structure according to some embodiments of the present disclosure. FIG. 9*b* is an unfolded schematic diagram illustrating an exemplary collapsible water-resistant structure according to some embodiments of the present disclosure. FIG. 9*c* is a schematic diagram illustrating an exemplary telescoping strip of a collapsible water-resistant structure according to some embodiments of the present disclosure;

In some embodiments, the outer side of the body 100 includes a collapsible water-resistant structure, as shown in FIG. 9*a*, FIG. 9*b*, and FIG. 9*c*. The collapsible water-resistant structure includes a folded cloth 171, a telescoping strip 172, and a fixing buckle 173, the telescoping strip 172 is fixed to the folded cloth 171. The folded cloth 171 is composed of a dense water-blocking material. As shown in FIG. 9*c*, the telescoping strip 172 may be a V-shaped strip composed of toughness material (e.g., a composite material such as sheet metal, carbon fiber, etc.), and when an external force is applied, the telescoping strip 172 may be curled and tightened to a V-shaped inner side. When the external force is released, an internal force of a V-shaped toughness material of the telescoping strip 172 prompts the telescoping strip 172 to unfold. The fixing buckle 173 is used to fix the folding cloth 171 and the telescoping strip 172 when being folded. The fixing buckle 173 may be a snap button, a hook and loop tape, etc. As shown in FIG. 9*a*, the collapsible water-resistant structure is in a folded state when the exerciser does not need to increase the resistance. When the exerciser needs to increase the resistance, the fixing buckle 173 is opened and the telescoping strip 172 is extended, as shown in FIG. 9*b*, the folded cloth 171 is fully unfolded, at which time the resistance is greatly increased.

In some embodiments, the folded cloth 171 may further be provided with a fixing strap fixed to fingers or toes, and the buoyant device with the collapsible water-resistant structure is worn on the wrist or the ankle, and the fixing strap fixes the folded cloth 171 to the fingers or the toes, at which point the buoyant device double as a hand flipper or a foot flipper.

In some embodiments, the body includes a multi-layer structure. In some embodiments, the multi-layer structure refers to a multi-layer formed by distance differences between a plurality of second distances d2 and the first distance d1 on an axis x-y plane (x-y as illustrated in FIG. 8*b*). For example, if the first distance of the body is 4 cm, and the distance differences between the plurality of second distances d2 and the first distance d1 are 2 cm, 3 cm, and 4 cm, respectively, such that the multi-layer structure is a 3-layer structure. In some embodiments, material densities of at least 2 layers of the multi-layer structure are different. Different materials of the multi-layer structure include a low-density foam material, a high-density foam material, and leather. Exemplarily, the inner layer may be a soft material (e.g., EVA or memory foam) to increase the comfort and the wearing experience. A middle layer may be a high-density foam material (e.g., polyethylene foam or polyurethane foam) or an airbag (e.g., an air cushion or an air cavity). The outer layer may be a material of relatively great abrasion-resistance and waterproof (e.g., a leather fabric or a leather coating) to protect an internal structure and increase the lifespan of a product.

In some embodiments, the multi-layer structure refers to multiple layers on a z-axis (as illustrated in FIG. 8*b*). For example, when the multi-layer structure is the 3-layer structure, there are a first layer, a second layer and a third layer from highest to lowest on the z-axis. Each layer of the multi-layer structure may be fixed to each other in the manner of the hook and loop tape or a connection manner of the connecting member as previously described. More descriptions regarding the hook and loop tape and the connecting member may be found in the above description.

In some embodiments, the outermost layer of the multi-layer structure may be the airbag. The airbag includes an inflation valve and an airbag cavity, and the exerciser may control an expansion by opening the inflation valve and inflating the airbag cavity, thereby adjusting the buoyancy of the buoyant device. The inflation valve may be a piston-like component. The airbag layer may be fixedly connected to other layers by sewing, gluing, fastening, etc. The airbag may adjust the buoyancy of the buoyant device within a wider range, increasing use scenarios of the buoyant device.

In some embodiments of the present disclosure, the exerciser may adjust the buoyancy according to the needs and requirements of the water activity. For example, by adding or removing a specific layer of a buoyancy block or the airbag layer, the exerciser may increase or decrease a level of the buoyancy to accommodate different training phases or individual abilities. At the same time, the multi-layer structure may help spread out a distribution of the buoyancy so that the buoyancy may act more evenly on the surface of the wrist or the arm, helping to reduce the pressure on a specific portion and providing a more comfortable and stable wearing sense.

In some embodiments, the outermost material of the buoyant device is a material with a low friction coefficient, or the outer side of the body is a coating consisting of a material with a low friction coefficient. The material with a low friction coefficient may include polyurethane, polyester, nylon, etc. The coating consisting of a material with a low friction coefficient includes hydrophobic coating, silicon coating, etc. The material with a low friction coefficient or the coating may reduce friction between the outer side of the buoyant device and the other portions of the body during the use of the buoyant device, and improve the comfort of using the buoyant device. In some embodiments, the material of low friction coefficient or the coating may also be disposed at a location where the buoyant device is in contact with a wearing portion, reducing the friction at the wearing portion.

In some embodiments, the body of the buoyant device is further provided with a scale, and the scale may indicate the first distance of the body or the inner circumference of the body, by which the scale indicates the portion (e.g., the wrist or the upper arm) where the buoyant device is applicable and an age (e.g., a child or an adult) where the buoyant device is applicable.

Figure 10:
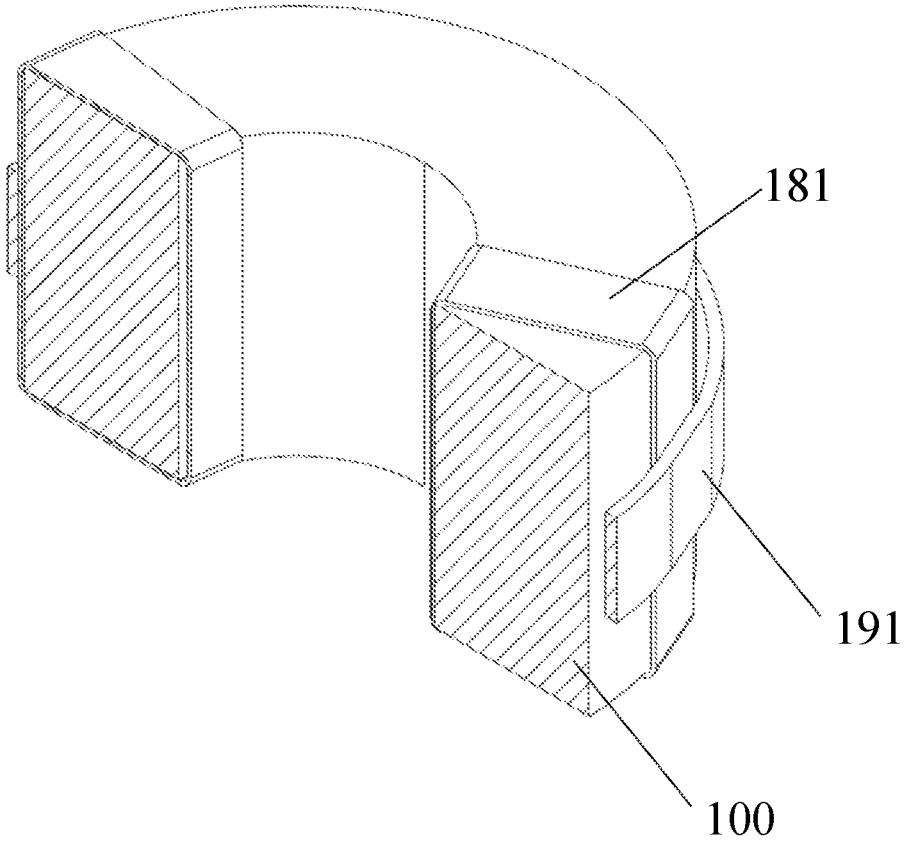
FIG. 10 is a structural diagram illustrating an exemplary strap of a buoyant device according to some embodiments of the present disclosure.

FIG. 10 is a structural diagram illustrating an exemplary strap of a buoyant device according to some embodiments of the present disclosure.

In some embodiments, as shown in FIG. 10, the buoyant device further includes a strap 181, the strap 181 connects a deformation determining member 191 and the body 100. When the deformation determining member 191 is directly connected to the body 100, the deformation determining member 191 and the body 100 may not be conveniently fixed due to difference in the material of the deformation determining member 191 and the material of the body 100, such that a fixation between the deformation determining member 191 and the body 100 may be more convenient and firm by introducing the strap 181 as a connecting transition between the deformation determining member 191 and the body 100.

FIG. 11*a*~FIG. 11*f* are structural diagrams illustrating exemplary buoyant devices according to some embodiments of the present disclosure.

Figure 11A:
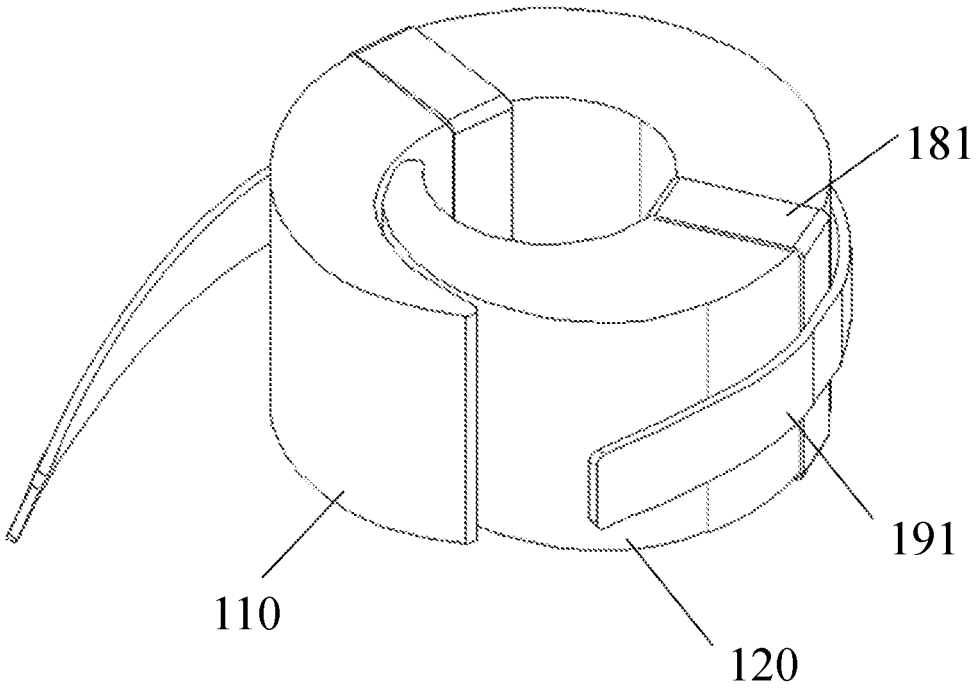
FIG. 11*a* is a structural diagram illustrating an exemplary buoyant device according to some embodiments of the present disclosure.

In some embodiments, as shown in FIG. 11*a*, the buoyant device includes the strap 181, the deformation determining member 191 is a hook and loop tape that extends from the first portion 110 to be fixed to a hook and loop tape of the second portion 120.

Figure 11B:
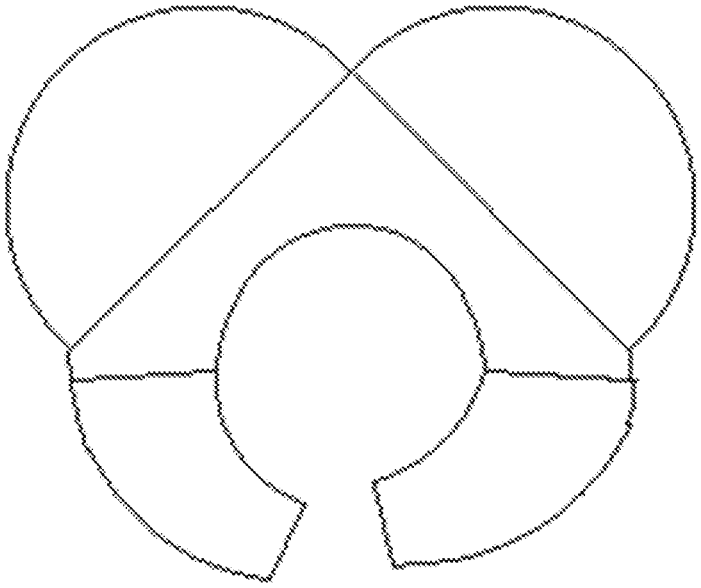
FIG. 11*b* is a structural diagram illustrating an exemplary buoyant device according to some embodiments of the present disclosure.
Figure 11C:
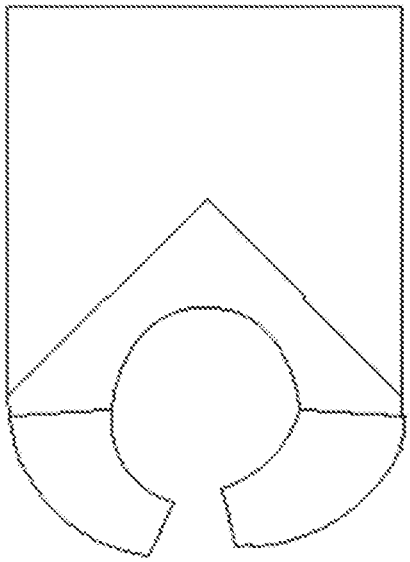
FIG. 11*c* is a structural diagram illustrating an exemplary buoyant device according to some embodiments of the present disclosure.

In some embodiments, as shown in FIG. 11*b* and FIG. 11*c*, the buoyant device includes a plurality of detachable components, and the plurality of detachable components may be connected to form a fan, a rectangle, etc.

Figure 11D:
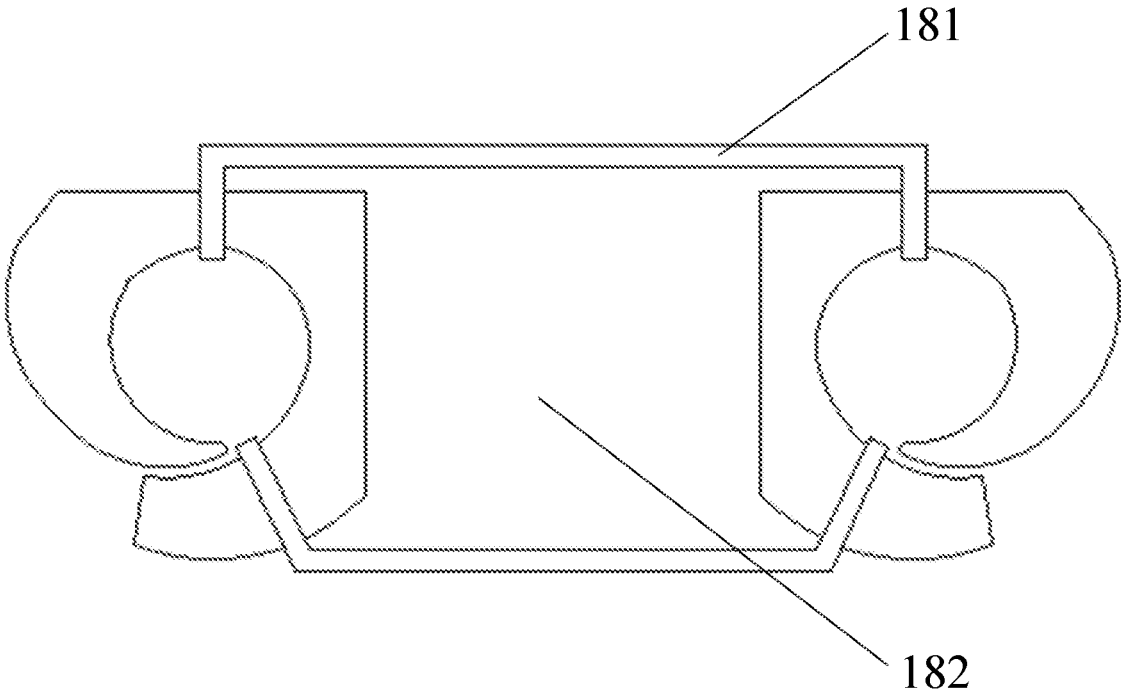
FIG. 11*d* is a structural diagram illustrating an exemplary buoyant device according to some embodiments of the present disclosure.

In some embodiments, the buoyant device may include a plurality of bodies. As shown in FIG. 11*d*, 2 bodies may be connected by the strap 181, thereby forming a new buoyant device. There is a wearing space 182 between the 2 bodies, and the wearing space 182 is not controlled by the size of the buoyant device and may be flexibly matched. For example, the new buoyant device may be worn around the waist and used as a flotation undershirt or a swimming ring.

In some embodiments, as shown in FIG. 11*d*, the 2 bodies may be connected by the strap 181, thereby forming the new buoyant device. There is the wearing space 182 between the 2 bodies, and the wearing space 182 is not controlled by the size of the buoyant device and may be flexibly matched. For example, the new buoyant device may be worn around the waist and used as the flotation undershirt or the swimming ring.

Figure 11E:
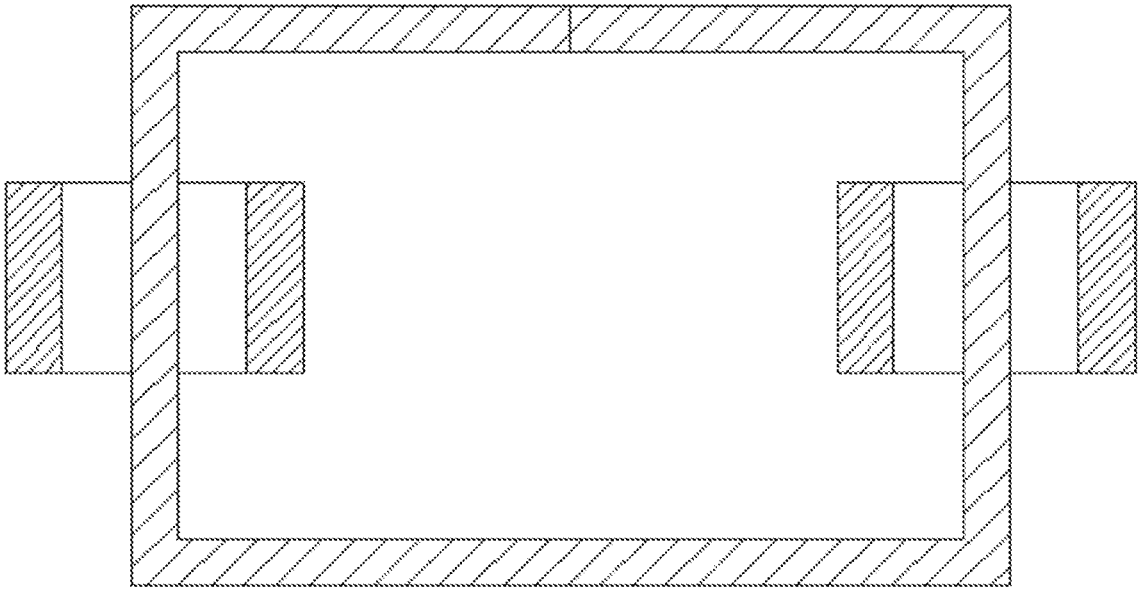
FIG. 11*e* is a structural diagram illustrating an exemplary buoyant device according to some embodiments of the present disclosure.

In some embodiments, as shown in FIG. 11*e*, the shape of the detachable component may also be in a frame-like shape, made of the same material as the body, with the buoyancy. The detachable component in the frame-like shape is used to connect two bodies to form the new buoyancy device that may be worn around the neck, serving as a neck swimming ring.

Figure 11F:
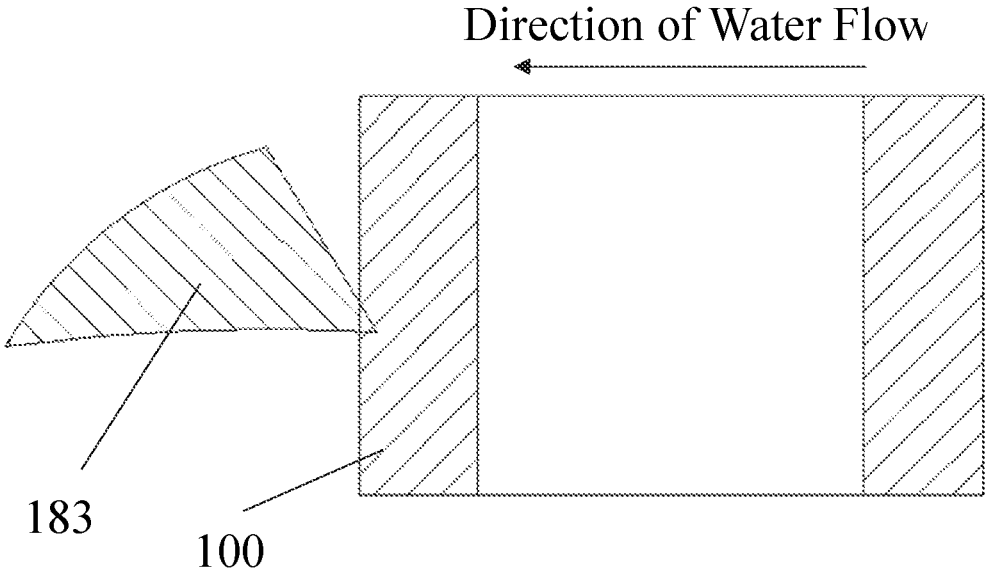
FIG. 11*f* is a structural diagram illustrating an exemplary buoyant device according to some embodiments of the present disclosure

In some embodiments, the shape of the detachable component may also be in a fin-like shape, and the fin-like component may be connected to the end face or the outer side of the body according to the needs. As shown in FIG. 11*f*, a fin-like component 183 is connected to the outer side of the body 100, and the fin-like component 183 may be a plate-like component with a streamlined curve and a width that tapers away from the body. The fin-like member 183 may reduce the resistance in the water in front of the body while swimming.

The buoyant device illustrated in some embodiments of the present disclosure may be made to have multiple functions and apply to a variety of scenarios by arranging the one or more deformation confirmation members and the one or more detachable connections. At the same time, the buoyant device may be sleeved onto the position such as the arm, the wrist, the ankle, and the neck, etc., which may meet a variety of exercise needs. The buoyant of the buoyant device and the resistance may be adjusted in a variety of manners, meeting different exercise needs of different exercisers.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure, or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures, or characteristics may be combined as suitable in one or more embodiments of the present disclosure.

Furthermore, the recited order of processing elements or sequences, or the use of numbers, letters, or other designations thereof, are not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software-only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in less than all features of a single foregoing disclosed embodiment.

In some embodiments, the numbers expressing quantities or properties used to describe and claim certain embodiments of the application are to be understood as being modified in some instances by the term "about," "approximate," or "substantially." For example, "about," "approximate," or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the count of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting effect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Therefore, by way of example, but not of limitation, alternative configurations of the embodiments of the application may be utilized in accordance with the teachings herein. Accordingly, embodiments of the present application are not limited to that precisely as shown and described.

What is claimed is:

1. A buoyant device for water-based aerobic exercises, comprising:

a body configured to generate buoyancy in water, the body including a first portion, a second portion, and a third portion and having a material density of less than 0.3 $kg/cm^3$, wherein a thickness of the body is measured by a distance difference between a first distance and a second distance from an axis around which the body is arranged, the first distance indicating an approximation value of an inner radius of the body and the second distance indicating an approximation value of an outer radius of the body, wherein the first distance is between 2.5 cm and 5.5 cm, and the distance difference between the second distance and the first distance is between 2.5 cm and 4.5 cm;

the first portion and the second portion are arranged at two ends of the third portion, respectively, the first portion and the second portion having an overlapping portion, the second portion being located farther away from the axis relative to the first portion;

the first portion and the second portion are configured to adjust a size of the buoyant device based on an overlapping size of the overlapping portion;

a rotation angle is an angle defined by having the axis as a center and two positions on the body;

a first rotation angle corresponds to a sub-portion of the first portion between an end position and a first position of the first portion, and a second rotation angle corresponds to a sub-portion of the first portion between the first position and a joint position of the first portion and the third portion, the first rotation angle being greater than the second rotation angle;

a first distance difference indicates a thickness at different positions of the sub-portion corresponding to the first rotation angle, a second distance difference indicates a thickness at different positions of the sub-portion corresponding to the second rotation angle, a first difference group being composed of a plurality of first distance differences, a second difference group being composed of a plurality of second distance differences, and the first distance differences of the first difference group being less than the second distance differences of the second difference group;

a third rotation angle corresponds to a sub-portion of the second portion between an end position and a second position of the second portion, and a fourth rotation angle corresponds to a sub-portion of the second portion between the second position and a joint position of the second portion and the third portion, the third rotation angle being greater than the fourth rotation angle;

a third distance difference indicates a thickness at different positions of the sub-portion corresponding to the third rotation angle, and a fourth distance difference indicates a thickness at different positions of the sub-portion corresponding to the fourth rotation angle, a third difference group being composed of a plurality of third distance differences, a fourth difference group being composed of a plurality of fourth distance differences, and the third distance differences of the third difference group being less than the fourth distance differences of the fourth difference group;

the third portion is configured to be applied to a body part of a user, the thickness of the first portion and the thickness of the second portion being less than a thickness of the third portion;

a deformation determining member configured to fix a deformation of the body, wherein the body is configured to support the deformation determining member, and the deformation determining member includes one or more of a hook and loop tape, an elastic band, a hook, a buckle, and a reel; and a strap configured to connect the deformation determining member and the body.

2. The buoyant device of claim 1, wherein the body includes a plurality of detachable components, and the plurality of detachable components are connected to each other by at least one connecting member.

3. The buoyant device of claim 2, wherein the plurality of detachable components include at least two buoyancy group components, the buoyancy group components are connectable to each other and configured to be connectable to the body, and the plurality of detachable components further include a container component configured to be placed on top of the at least two buoyancy group components to form an accommodating space.

4. The buoyant device of claim 1, wherein the third portion includes a first sub-piece and a second sub-piece that are interchangeable, the first sub-piece causes the first distance of the body to be between 5.5 cm and 6.5 cm, and the second sub-piece causes the first distance of the body to be between 6 cm and 7 cm.

5. The buoyant device of claim 1, wherein the body includes a multi-layer structure, and material densities of at least two layers are different.

6. The buoyant device of claim 5, wherein one layer of the multi-layer structure is an airbag layer, the airbag layer being configured to adjust a buoyancy of the buoyant device by controlling an expansion of the airbag.

7. The buoyant device of claim 2, wherein the at least one connecting member is further disposed on at least one cross-section of the body, the at least one cross-section of the body satisfies:

an outer distance difference being less than an inner distance difference; and the at least one cross-section is an intersection of a plane where the axis is located with the body.

8. The buoyant device of claim 1, wherein the deformation determining member includes a wrapping mesh, and the wrapping mesh is composed of a dense waterproof fabric.

9. The buoyant device of claim 1, wherein an outer side of the body includes a water-resistant structure, the water-resistant structure being configured to create resistance to water flow and increase resistance of the body.

10. The buoyant device of claim 9, wherein the water-resistant structure is disposed on a circular assembly, and the circular assembly is capable of being embedded in the body at different angles.

11. The buoyant device of claim 9, wherein the water-resistant structure is a collapsible water-resistant structure.

12. The buoyant device of claim 5, wherein an outermost material of the buoyant device is a material including polyurethane, polyester, and nylon.

13. The buoyant device of claim 9, wherein at least one end face of the body satisfies: a plurality of distance differences arranged along a direction perpendicular to an axis plane include at least two local maximum points, and the water-resistant structure further includes a curved surface feature formed by the at least two localized maximum points on the at least one end face of the body.

14. The buoyant device of claim 6, wherein the airbag layer includes an inflation valve and an airbag cavity, the inflation valve is configured to control the expansion of the airbag layer by controlling an expansion of the airbag cavity through the inflation valve, and the airbag layer is fixedly connected to other layers by sewing, gluing, and fastening.

15. The buoyant device of claim 11, wherein the collapsible water-resistant structure includes a folded cloth, a telescoping strip, and a fixing buckle, wherein the telescoping strip is fixed to the folded cloth, the folded cloth is composed of a dense water-blocking material, and the telescoping strip is a V-shaped strip composed of toughness material, and the fixing buckle is configured to fix the folding cloth and the telescoping strip when the collapsible water-resistant structure is folded.

16. The buoyant device of claim 11, wherein the folded cloth further includes a fixing strap fixed to fingers or toes of a user.

17. The buoyant device of claim 11, wherein the buoyant device includes a plurality of bodies, two bodies of the plurality of bodies are connected by a strap to form a wearing space of a user.

18. The buoyant device of claim 15, wherein the telescoping strip is curled and tightened to a V-shaped inner side when an external force is applied, and the telescoping strip is prompted to be unfolded by an internal force of a V-shaped toughness material of the telescoping strip when the external force is released.

19. The buoyant device of claim 1, wherein the first portion includes an end surface including a first connecting member, the second portion includes an end surface including a second connecting member, and the two ends of the third portion include a third connecting member and a fourth connecting member, respectively.

20. The buoyant device of claim 19, wherein the first portion and the second portion are detachably connected to the two ends of the third portion through the first connecting member, the second connecting member, the third connecting member, and the fourth connecting member, and the first connecting member, the second connecting member, the third connecting member, and the fourth connecting member are a groove or a protrusion, the groove being configured to hinder the protrusion from being dislodged from the groove when being connected.

* * * * *